US007137859B2

(12) United States Patent
Nishida

(10) Patent No.: US 7,137,859 B2
(45) Date of Patent: Nov. 21, 2006

(54) HIGH-PRESSURE DISCHARGE LAMP

(75) Inventor: Kazuhisa Nishida, Tokyo (JP)

(73) Assignee: NEC Corporation, Tokyo (JP)

( * ) Notice: Subject to any disclaimer, the term of this patent is extended or adjusted under 35 U.S.C. 154(b) by 308 days.

(21) Appl. No.: 10/803,970

(22) Filed: Mar. 19, 2004

(65) Prior Publication Data

US 2004/0189205 A1 Sep. 30, 2004

Related U.S. Application Data

(62) Division of application No. 10/201,693, filed on Jul. 24, 2002, now Pat. No. 6,737,807.

(30) Foreign Application Priority Data

Aug. 6, 2001 (JP) ..... 2001-237678

(51) Int. Cl.
*H01J 9/04* (2006.01)

(52) U.S. Cl. ..... 445/48; 445/49

(58) Field of Classification Search ..... 445/46, 445/48–52, 58, 35; 140/71.5, 71.6, 111, 140/112; 313/628, 631, 632, 344
See application file for complete search history.

(56) References Cited

U.S. PATENT DOCUMENTS

| | | | | |
|---|---|---|---|---|
| 4,525,379 | A * | 6/1985 | Hubner et al. | 427/586 |
| 5,109,181 | A | 4/1992 | Fischer et al. | |
| 5,186,671 | A * | 2/1993 | Nagasawa et al. | 445/49 |
| 6,492,772 | B1 | 12/2002 | Takeuchi | |
| 6,545,430 | B1 * | 4/2003 | Ono et al. | 315/291 |
| 6,705,914 | B1 * | 3/2004 | Tsutatani et al. | 445/50 |
| 6,817,920 | B1 * | 11/2004 | Furuta et al. | 445/58 |

FOREIGN PATENT DOCUMENTS

| | | |
|---|---|---|
| EP | 1 028 453 | 8/2000 |
| EP | 1 150 336 | 10/2001 |
| JP | 44-30956 | 12/1969 |
| JP | 49-42394 | 11/1974 |
| JP | 60-28155 | 2/1985 |
| JP | 03-225741 | 10/1991 |
| JP | 3-274649 | 12/1991 |
| JP | 4-277436 | 10/1992 |
| JP | 06-013029 | 1/1994 |

(Continued)

OTHER PUBLICATIONS

European Search report dated Aug. 29, 2003.

(Continued)

*Primary Examiner*—Karabi Guharay
*Assistant Examiner*—Dalei Dong
(74) *Attorney, Agent, or Firm*—Whitham, Curtis, Christofferson & Cook, PC

(57) ABSTRACT

A high-pressure discharge lamp is produced using tungsten wire that is wound as a double coiled winding around an electrode metal rod, leaving a tip end thereof, and the double coiled winding is machined into a melted tip end by a YAG laser beam, with the remaining double coiled winding used as a coil. The tip end of the metal rod is machined into a nipple on the distal end of the melted tip. The melted tip has a diameter D1 and a length L1, the nipple has a proximal end having a diameter D2 and a length L2, and the coil and the melted tip end (including the nipple) have a volume V1 and the melted tip end (including the nipple) has a volume V2, when the electrode assembly is machined to satisfy at least one of the conditions $0.15 \leqq D2/D1 \leqq 0.3$, $0.2 \leqq L2/L1 \leqq 0.4$, and $0.2 \leqq V2/V1 \leqq 0.4$.

2 Claims, 3 Drawing Sheets

FOREIGN PATENT DOCUMENTS

| | | |
|---|---|---|
| JP | 6-89699 | 3/1994 |
| JP | 10-092377 | 4/1998 |
| JP | 10-208693 | 8/1998 |
| JP | 11-123577 | 5/1999 |
| JP | 11-149899 | 6/1999 |
| JP | 2000-123768 | 4/2000 |
| JP | 2000-231902 | 8/2000 |
| JP | 2000231902 | 8/2000 |
| JP | 2000-299086 | 10/2000 |
| JP | 2001-312997 | 11/2001 |
| JP | 2001-325918 | 11/2001 |
| JP | 2001-351573 | 12/2001 |
| JP | 2002-83538 | 3/2002 |

OTHER PUBLICATIONS

Japanese Office Action dated Jun. 9, 2004 with English translation of pertinent portions.

* cited by examiner

HIGH-PRESSURE DISCHARGE LAMP

CROSS-REFERENCE TO RELATED APPLICATIONS

This application is a divisional application of U.S. Ser. No. 10/201,693, filed Jul. 24, 2002, and the complete contents thereof is herein incorporated by reference.

BACKGROUND OF THE INVENTION

1. Field of the Invention

The present invention relates to a high-pressure discharge lamp, and more particularly to the shape of an electrode of a high-pressure discharge lamp and a method of manufacturing such a high-pressure discharge lamp.

2. Description of the Related Art

In the field of ultrahigh-pressure mercury lamps (high-pressure discharge lamps), as electrodes are designed for shorter arcs across the electrode gap, reductions and fluctuations in the illuminance due to temperature rises of the electrodes and variations of discharge starting points are posing serious problems.

For suppressing a blackening phenomenon due to a scattering of tungsten, it has been proposed, as disclosed in Japanese laid-open patent publication No. 2000-299086, to construct an electrode to meet the condition of $1/50*R3 \leqq \Delta L \leqq 1/5*R3$ where R3 represents the diameter of a thicker coil of the double winding of the electrode and ΔL represents the distance between the tip end of the thicker coil and the tip end of the electrode, and also to ensure that the tip end of the electrode be fixed in position by being welded when energized after the lamp bulb is sealed.

Japanese laid-open patent publication No. 6-13029 discloses an electrode shaped such that the diameter (D) progressively increases from the base end to the tip end thereof and the electrode has a tip having a small diameter (d) on the face of the thicker tip end, the diameters satisfying the relationship of $0.2<d/D<0.5$.

Japanese laid-open patent publication No. 10-92377 reveals an electrode having a structure of large thermal capacity disposed on the tip end thereof and having a diameter greater than the shank of the electrode, and a heat radiator disposed behind the electrode and comprising a tungsten wire coiled around the shank of the electrode.

Japanese laid-open patent publication No. 10-208693 shows an electrode having a thick wound portion which comprises a tungsten wire (diameter=$\phi_K$) coiled as a double winding around an electrode rod (diameter=$\phi_E$) from behind (d) the tip end of the electrode rod. If the lamp power is represented by W and the initial current peak value by A, then the ranges of $0.0017\times W+0.18 \leqq \phi_E \leqq 0.0017\times W+0.38$ and $A\times\sqrt{d/(\phi_E+\phi_K)} \geqq 12$ are satisfied.

Conventional high-pressure discharge lamps have suffered the problems of the blackening of outer casings due to a scattering of tungsten and illuminance fluctuations, and various countermeasures have been proposed to improve those shortcomings.

Japanese laid-open patent publication No. 2000-299086 attempts to avoid the blackening phenomenon by limiting an initial structure of the tip end of the electrode such that the distance between the electrodes remains unchanged even when they are melted by a discharge caused by an initial current. However, the disclosed electrode structure fails to avoid the instability of a discharge starting point which is responsible for illuminance fluctuations.

According to Japanese laid-open patent publication No. 6-13029, the electrode is prevented from being heated by a large current based on a large thermal capacity which is provided by a frustoconical electrode shape with a projection at its tip end. However, since the tip end of the electrode has a blocky large shape, the cooling factor is poorer than an electrode having a coiled heat radiator, and the electrode has a large size and is not sufficiently efficient.

According to Japanese laid-open patent publication No. 10-92377, the heat radiating coil is wound around the electrode, and the electrode shank at the tip end is melted into a semispherical electrode, so that the electrode can easily be machined. The electrode surface is generally semispherical in shape and may be machined into a truncated conical shape. However, the disclosed electrode fails to prevent the instability of a discharge starting point, and is expected to suffer illuminance fluctuations.

According to Japanese laid-open patent publication No. 6-13029, the electrode has an electrode portion greater in diameter than the electrode shank to suppress an excessive temperature increase with an electrode structure having a large thermal capacity and a heat radiating structure of a coiled winding. However, the electrode portion on the tip end is spherical or truncated conical in shape, causing an unstable discharge starting point which is responsible for illuminance fluctuations.

Japanese laid-open patent publication No. 10-208693 discloses that the maximum temperature of the electrode is lowered to provide good service life characteristics and initial characteristics by lowering an initial current peak value immediately after the lamp starts to be energized. However, because the tip end of the electrode has a cross-sectional shape which is equal to the cross-sectional shape of the electrode rod, the electrode causes an unstable discharge starting point which is responsible for illuminance fluctuations. Furthermore, there is a danger of a coil discharge between the tip end of the electrode and the tip end of the coil. Since it is important to provide conditions for setting up an allowable range for preventing the coil discharge, the disclosed electrode is disadvantageous in that a strict process of machining the electrode is required.

SUMMARY OF THE INVENTION

It is therefore an object of the present invention to provide a high-pressure discharge lamp which can easily be limited by numerical values, is effective to prevent blackening on an outer casing thereof, and is of a long service life.

According to the present invention, there is provided a high-pressure discharge lamp comprising an outer casing of quartz glass filled with mercury, an inactive gas, and a halogen gas, a pair of electrodes disposed in the outer casing and coupled to respective sealing metal foil members, each of the electrodes comprising a metal rod and a metal wire closely wound around the metal rod, the electrode having a semispherical or truncated conical tip end with a smooth surface in the shape of a solid of revolution, with a nipple disposed on the distal end of the tip end.

The mercury is present in an amount ranging from 0.12 to 0.30 $mg/mm^3$ and at least one of Cl, Br, and I is present as the halogen gas in an amount ranging from $10^{-8}$ through $10^{-2}$ $\mu mol/mm^3$.

The tip end and the nipple are formed by a YAG laser beam machining process. Preferably, the tip end has a base portion having a diameter D1 and the nipple has a proximal end having a diameter D2, the ratio D2/D1 being in the range of $0.15 \leqq D2/D1 \leqq 0.3$.

Preferably, the tip end has a length L1 and the nipple has a length L2, the ratio L2/L1 being in the range of $0.2 \leqq L2/L1 \leqq 0.4$. The electrode including the coil, the nipple, and the tip end has a volume V1 and the tip end including the nipple has a volume V2, the ratio V2/V1 being in the range of $0.2 \leqq V2/V1 \leqq 0.4$. The tip end has a diameter D1 and the nipple has a proximal end having a diameter D2, the ratio D2/D1 being in the range of $0.15 \leqq D2/D1 \leqq 0.3$.

According to the present invention, there is also provide a method of manufacturing a high-pressure discharge lamp, comprising the steps of combining an electrode metal rod and a heat radiating coil into an electrode assembly with a dedicated jig, placing the electrode assembly on a predetermined jig, machining the electrode assembly with a YAG laser beam while the electrode assembly is in rotation, to turn the tip end of the coil into a body of rotation with a smooth surface, leaving a central region of the tip end of the metal rod, thus producing a melted tip end, and machining the left central region of the tip end of the metal rod into a nipple.

The above and other objects, features, and advantages of the present invention will become apparent from the following description with reference to the accompanying drawings which illustrate an example of the present invention.

DESCRIPTION OF THE PREFERRED EMBODIMENT

Figure 1:
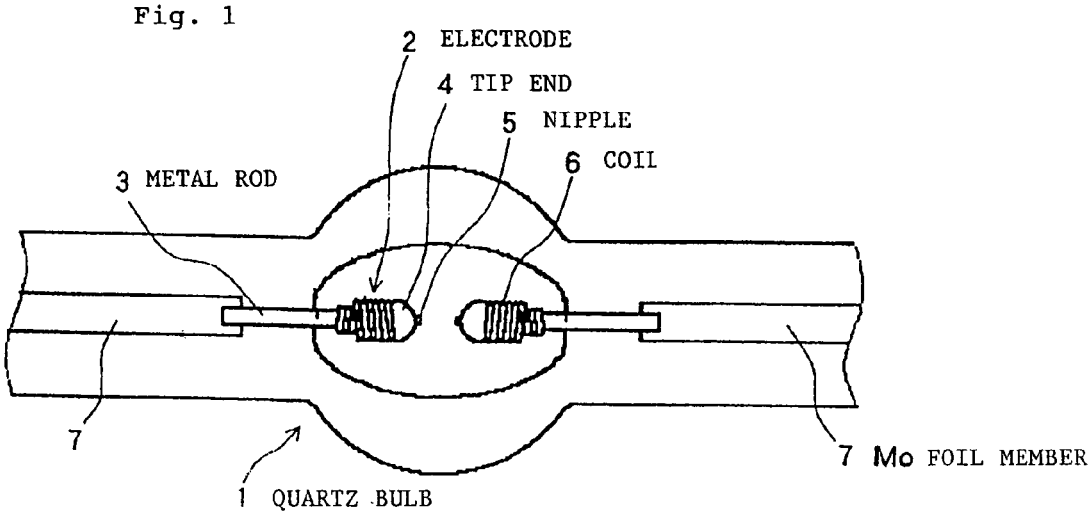
FIG. 1 is a fragmentary longitudinal cross-sectional view of a high-pressure discharge lamp according to the present invention.
Figure 2:
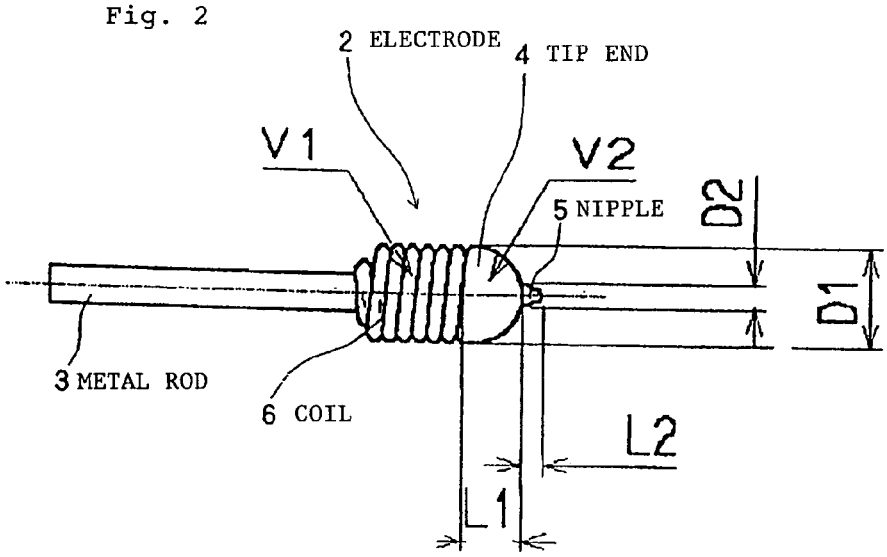
FIG. 2 is an enlarged view of an electrode of the high-pressure discharge lamp shown in FIG. 1.

As shown in FIGS. 1 and 2, a high-pressure discharge lamp according to the present invention comprises quartz bulb 1, a pair of electrodes 2, and a pair of molybdenum foil members 7. Electrodes 2 are joined to respective molybdenum foil members 7 as by welding, and quartz bulb 1 and molybdenum foil members 7 are hermetically sealed.

Each of electrodes 2 comprises metal rod 3 and coil 6 of a tungsten wire closely wound around metal rod 3. The tip end of metal rod 3 and the tip end of coil 6 are melted by a YAG laser beam or the like and integrally united into semispherical melted tip end 4 with nipple 5 disposed on its distal end.

Quartz bulb 1 is filled with mercury in an amount ranging from 0.12 to 0.30 mg/mm$^3$ and an inactive gas in an amount ranging from $10^{-8}$ through $10^{-2}$ μmol/mm$^3$.

Usually, a power supply connected to electrodes 2 applies a trigger voltage to electrodes 2, starting to produce a discharge therebetween to enable the high-pressure discharge lamp to emit light with a desired level of luminance.

Since the tip end of metal rod 3 and the tip end of coil 6 are melted and integrally united into semispherical melted tip end 4 with nipple 5 on its distal end, semispherical melted tip end 4 and nipple 5 are efficiently cooled by coil 6. As a result, undue consumption of the electrodes due to a discharge between the electrodes during operation of the high-pressure discharge lamp is reduced, lowering any blackening on the inner wall of quartz bulb 1. Nipple 5 on the distal end of melted tip end 4 of the electrode is effective to suppress or stabilize variations of the discharge starting point, thus reducing illuminance fluctuations while the high-pressure discharge lamp is in operation. Consequently, the high-pressure discharge lamp is of a longer service life and is more reliable than conventional high-pressure discharge lamps.

Figure 3:
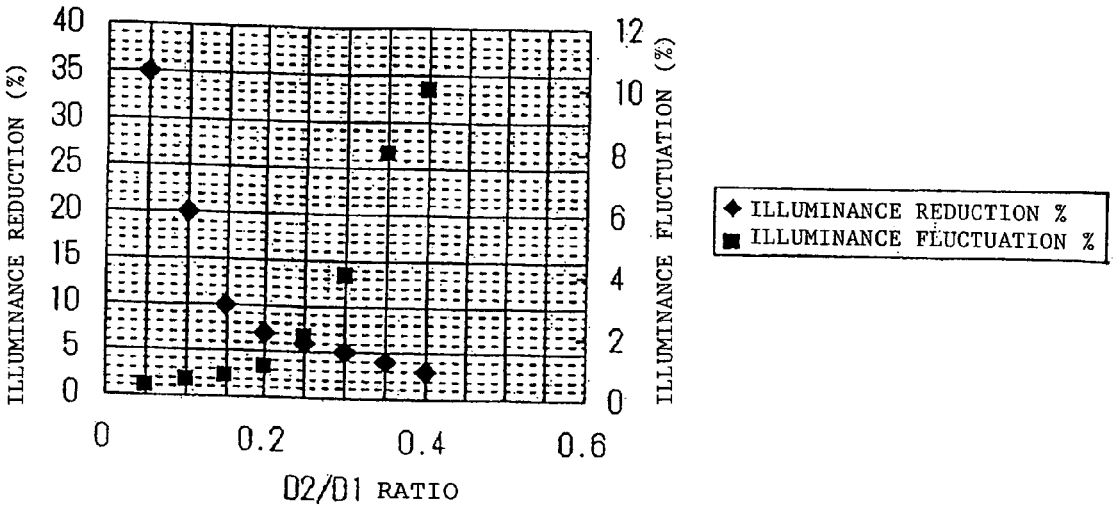
FIG. 3 is a graph of illuminance reduction percentages and illuminance fluctuation percentages after elapse of 30 hours of operation of the high-pressure discharge lamp with the electrode structure shown in FIG. 2, using a D2/D1 ratio as a parameter.
Figure 4:
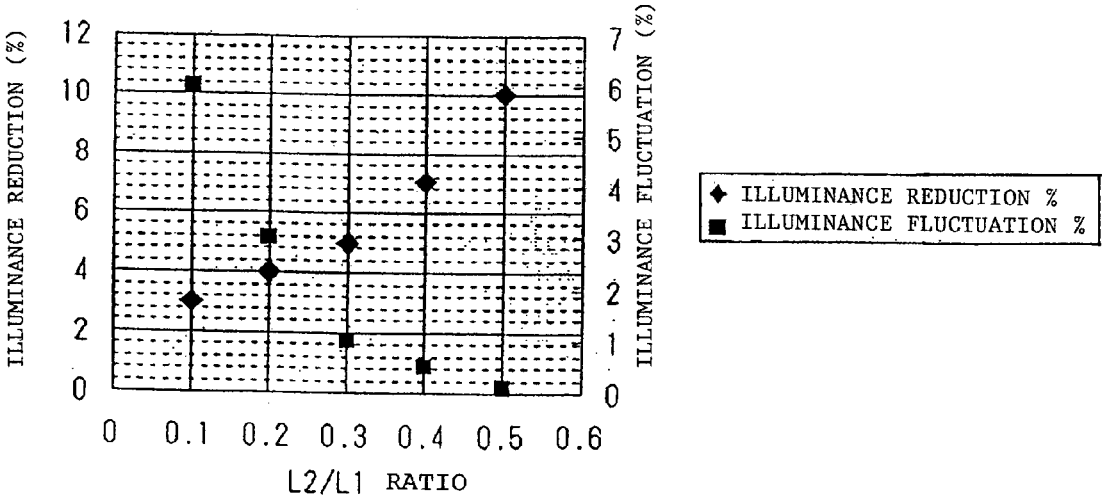
FIG. 4 is a graph of illuminance reduction percentages and illuminance fluctuation percentages after elapse of 30 hours of operation of the high-pressure discharge lamp with the electrode structure shown in FIG. 2, using an L2/L1 ratio as a parameter.
Figure 5:
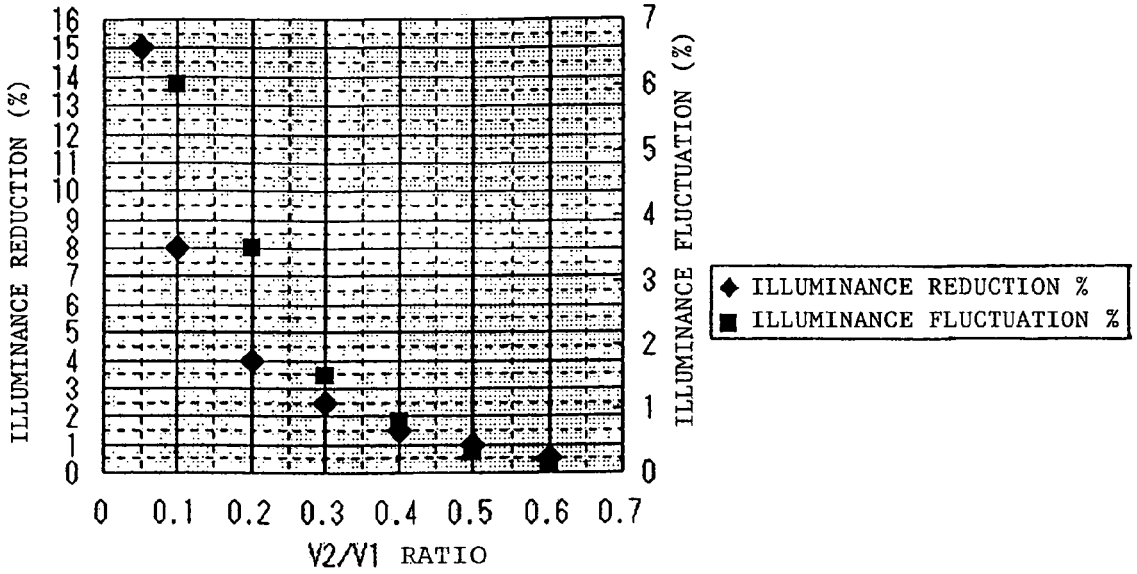
FIG. 5 is a graph of illuminance reduction percentages and illuminance fluctuation percentages after elapse of 30 hours of operation of the high-pressure discharge lamp with the electrode structure shown in FIG. 2, using a V2/V1 ratio as a parameter.

As shown in FIG. 2, semispherical melted tip end 4 has a diameter D1, nipple 5 has a proximal end having a diameter D2, semispherical melted tip end 4 has a length L1, nipple 5 has a length L2, electrode 2 (including coil 6, semispherical melted tip end 4, and nipple 5) has a volume V1, and semispherical melted tip end 4 (including nipple 5) has a volume V2. Illuminance reduction percentages and illuminance fluctuation percentages of the high-pressure discharge lamp were measured when the ratios D2/D1, L2/L1, and V2/V1 were changed, and ranges of these dimensions which pose no practical problems were determined. The results are shown in FIGS. 3 through 5. The data shown in FIGS. 3 through 5 represent measured values after elapse of 30 hours of operation of the high-pressure discharge lamp.

The illuminance reduction percentages, and illuminance fluctuation percentages exhibited good values when the ratio D2/D1 was in the range of $0.15 \leqq D2/D1 \leqq 0.3$. The illuminance reduction percentages and illuminance fluctuation percentages exhibited good values when the ratio L2/L1 was in the range of $0.2 \leqq L2/L1 \leqq 0.4$. The illuminance reduction percentages and illuminance fluctuation percentages exhibited good values when the ratio V2/V1 was in the range of $0.2 \leqq V2/V1 \leqq 0.6$.

With respect to the volume ratio V2/1, it has been found that a YAG laser beam machining process has a practical limitation represented by a ratio V2/V1 of 0.4, and the range of $0.2 \leqq V2/V1 \leqq 0.4$ is an appropriate range. By designing a high-pressure discharge lamp to set the ratios D2/D1, L2/L1, and V2/V1 to the above ranges, the high-pressure discharge lamp is highly reliable with respect to illuminance reduction characteristics and illuminance fluctuation characteristics.

In example 1, a high-pressure discharge lamp with D2/D1=0.25, L2/L1=0.3, and V2/V1=0.4 has an illuminance reduction of −20% and an average illuminance fluctuation of 2% after 2000 hours of operation.

A process of melting the tip end of the electrode will be described below. Metal rod 3 and coil 6 are combined with each other by a dedicated jig, producing an assembly, and then the assembly is placed on a given jig. While the assembly is being rotated, the tip end thereof is machined by a YAG laser beam with a laser energy of several J/pulse. By machining the tip end of the assembly to leave a central region thereof, a nipple is formed on the tip end of the assembly. It is important in the laser beam machining process to optimize the rotational speed of the assembly and the energy condition of the YAG laser beam.

In example 2, a high-pressure discharge lamp similar to example 1, but with D2/D1=0.3, L2/L1=0.2, and V2/V1=0.2, had an illuminance reduction of 30% and an average illuminance fluctuation of 3% after 2000 hours of operation.

According to the present invention, as described above, certain allowable ranges are established for various dimensions of the electrode, and a high-pressure discharge lamp with electrodes designed within the allowable ranges is free of the blackening phenomenon and suffers low illuminance reductions and illuminance fluctuations after long hours of use.

The reasons for the above advantages of the high-pressure discharge lamp are that since the coil effective for cooling the tip end of the electrode and the metal rod are melted and integrally united thereby to efficiently cool the tip end of the electrode, reduce undue consumption of the tip end of the electrode, prevent the inner wall of the quartz bulb from blackening, and reduce illuminance reductions. The nipple on the melted tip end of the electrode is effective to suppress illuminance fluctuations caused by variations of discharge starting points at the tip end of the electrode when the high-pressure discharge lamp is in operation. As a result, the high-pressure discharge lamp is of a long service life and is highly reliable in operation.

While a preferred embodiment of the present invention has been described using specific terms, such description is for illustrative purposes only, and it is to be understood that changes and variations may be made without departing from the spirit or scope of the following claims.

What is claimed is:

1. A method of manufacturing a high-pressure discharge lamp, comprising the steps of:

combining an electrode metal rod and a heat radiating coil into an electrode assembly to produce a melted tip end from a portion of said heat radiating coil with a protruding end of said metal rod, wherein said melted tip end has a length L1 and a diameter D1; and machining said end of said metal rod into a nipple, wherein said nipple has a length L2 and diameter D2, and wherein a volume of said electrode assembly and said nipple has volume V1 and wherein a volume of said end and said nipple has a volume V2, and wherein said machining step produces an electrode assembly where at least one of the conditions $0.15 \leqq D2/D1 \leqq 0.3$, $0.2 \leqq L2/L1 \leqq 0.4$, or $0.2 \leqq V2/V1 \leqq 0.4$ are met.

2. The method of claim 1 wherein said machining step produces an electrode assembly where all of the conditions $0.15 \leqq D2/D1 \leqq 0.3$, $0.2 \leqq L2/L1 \leqq 0.4$, and $0.2 \leqq V2/V1 \leqq 0.4$ are met.

* * * * *